US008269084B2

(12) United States Patent
Ludwig

(10) Patent No.: US 8,269,084 B2
(45) Date of Patent: Sep. 18, 2012

(54) FINGER SLEEVE WITH RAISED FLEXIBLE BAR FOR PLAYING BARRE CHORDS

(75) Inventor: Vincent Charles Ludwig, Sherwood Park (CA)

(73) Assignee: Vince Ludwig, Sherwood Park, Alberta ( * ) Notice: Subject to any disclaimer, the term of this patent is extended or adjusted under 35 U.S.C. 154(b) by 0 days.

(21) Appl. No.: 13/103,709

(22) Filed: May 9, 2011

(65) Prior Publication Data

US 2011/0296974 A1 Dec. 8, 2011

Related U.S. Application Data

(60) Provisional application No. 61/396,788, filed on Jun. 3, 2010.

(51) Int. Cl.
*G10D 3/00* (2006.01)

(52) U.S. Cl. ..... 84/315

(58) Field of Classification Search ..... 84/315–319
See application file for complete search history.

(56) References Cited

U.S. PATENT DOCUMENTS 3,638,525 A * 2/1972 Sciurba et al. ..... 84/319
3,854,368 A 12/1974 Pogan
4,817,488 A 4/1989 des los Santos
5,390,371 A 2/1995 Sigward
5,492,045 A 2/1996 Roblee
5,515,762 A 5/1996 Perkins et al.
5,577,272 A 11/1996 Fisher
6,160,212 A 12/2000 Morse
6,369,307 B1 4/2002 Wells
7,251,836 B2 8/2007 Santiago
7,476,792 B1 1/2009 Musser

OTHER PUBLICATIONS

Bozung, Guitar Barre, www.guitarsimplified.com, Oct. 2010.
Mosteferis, The Secret Weapon for Bar Chords, www.bcmmusic.org/projsecrets.htm.

* cited by examiner

*Primary Examiner* — Kimberly Lockett

(57) ABSTRACT

One embodiment of a tight fitting finger sleeve is presented which has a raised flexible bar to assist in playing a stringed musical instrument, such as a guitar, in a style that includes barre chords. The finger sleeve (10) is configured with an internal cavity (11) to accept the insertion of a musician's index finger (14) and is made of an elastomeric material that provides a frictional connection with the finger and can be repeatedly bent and straightened without restriction. In addition, a raised flexible bar (12) is attached to the finger sleeve (10) along the longitudinal axis from the proximal end (13) to the distal end (15) and is made of a flexible material that can be repeatedly bent and straightened without restriction while providing the rigidity required to compress a number of guitar strings (16) at various fret positions (17) along a guitar fingerboard (18) as required when playing barre chords. The finger sleeve with raised flexible bar is designed for substantially improved playing qualities, aesthetically appealing appearance, and superior comfort.

2 Claims, 2 Drawing Sheets

FINGER SLEEVE WITH RAISED FLEXIBLE BAR FOR PLAYING BARRE CHORDS

CROSS-REFERENCE TO RELATED APPLICATION

This application claims the benefit of provisional application Ser. No. 61/396,788, filed 2010 Jun. 3 by the present inventor.

BACKGROUND

1. Field

This application relates to musical instrument accessories, and more specifically to a fingering device for stringed instruments. Such a device is to provide assistance in playing guitar barre chords by enabling a musician to deploy a finger sleeve with a raised flexible bar to contact and depress a number of strings while leaving the musician's finger available for fingerboard fretting.

2. Prior Art

The guitar is one of the most popular musical instruments world-wide. The playing of the guitar requires co-ordination and dexterity to be able to pluck or strum the strings with one hand while simultaneously depressing the strings with the other hand's fingers to create a variety of melodic sounds. The formation of chords is one of the first things a beginning guitarist learns. Chords are created by forming the fingers of the left hand (assuming a right-handed player, reversed for left-handed players) into various shapes on the guitar neck or fingerboard. These chord shapes are referred to as open chords and are named with letters such as C, A, G, E, and D and are the foundation for musical composition.

Once a guitarist is familiar with these chord shapes, most often the next step is to learn barre chords (or bar chords). Barre chords, which are also referred to as moveable chords, enable a guitarist to move the open chord shapes up and down the guitar fingerboard allowing for a wider range of musical sounds and includes the ability to incorporate additional chords such as B and F that are not usually played with open chords. The barre chord is formed by using the length of a single finger (most often the index finger) to simultaneously press down on a number of strings at certain intervals (referred to as frets) along the guitar fingerboard while using the remaining fingers of the same hand to form chord shapes. The pressing of the finger on the strings is similar to pressing a soft bar on the strings which is referred to as barring or bar pressure. This action alters the tones of the guitar and enables the guitarist to play chords not restricted by the nature of the guitar's open strings.

It is common knowledge in the music world, and more particularly in the guitar world, that the task of performing barre chords by pressing all or most of the strings in a fret simultaneously with a single finger is one of the most difficult and frustrating aspects of learning and playing guitar. Most often the notes of the chord will not ring clearly or will sound muted due to the strings not being depressed sufficiently or fully by the barring finger. One of the most common problems occurs as a result of one or more of the strings resting in the joint creases of the finger resulting in an inability to depress all of the strings with equal pressure. Many guitarists avoid songs that require the use of barre chords, opting for other chord options that may create a slightly similar sound, but are not a correct musical composition. It is also common knowledge that playing, or attempting to play barre chords for an extended period is tiring and creates joint pain in the wrist and fingers due to the amount of pressure required to press the strings firmly enough with the finger to produce a satisfactory sound.

In an attempt to address these issues, U.S. Pat. No. 5,390,371 to Sigward (1993) discloses a guitar glove that as one of its functions comprises a plurality of raised elongated cushioning strips running the length of the radial side of the index finger. The problem related to playing barre chords has been partially solved by the addition of the raised strips along the index finger but still has significant problems. In glove form the location of the raised strips are fixed to a set location on the finger in relation to how the glove sits on the hand, whereas a guitarist may find it suitable to adjust rotationally or vertically the raised strips to a different location on the finger such as farther to the radial side of the finger or directly in the middle on the underside of the finger. As well, in order to attain the benefit of the raised strips on the index finger, the user is required to wear an entire glove which would be cumbersome to the guitarist who prefers the natural feel of a bare hand, or who would like to remove or deploy the playing aid quickly as required. The glove is designed for right handed players and would require additional manufacturing costs to accommodate left-handed guitar players.

Several other slightly similar guitar finger attachments have been proposed—for example U.S. Pat. No. 3,638,525 to Sciurba et al. (1972), and U.S. Pat. No. 7,476,792 to Musser (2009). Although they both describe a finger attachment for depressing guitar strings while providing finger flexibility, they both require manual rotation on the finger to achieve alternate playing styles, whereas my invention describes a finger sleeve that requires no adjustment once in place on the finger. These and many other similar prior art designs have been described that provide a finger attachment to assist a musician in creating different musical sounds. In these examples, and others like them, the finger attachment is constructed of a hard material such as metal or plastic which when placed against the strings of a guitar create a specific desired sound described variously as steel, slide, or Hawaiian. These sounds depart drastically from the pure chord sound desired by a musician playing barre cords.

Lastly, U.S. Pat. No. 5,492,045 to Roblee (1996) discloses a quick release capo, designed for fretting the neck of a stringed instrument. In this design, a mechanism is attached to the fingerboard of a guitar or other stringed instrument at various fret positions. When employed, a padded bar is pressed firmly across the strings creating a barre. This design provides the musician the ability to perform barre chords, but requires that the user attach and detach the device when required at different fret positions. Although this design provides a new and quicker alternative to conventional capos, it would be significantly slower in transition from one location on a fingerboard to another than employing a finger sleeve to perform barre chords.

In this respect, the finger sleeve according to the present invention substantially departs from the conventional concepts and designs of the prior art, and in doing so, provides an apparatus primarily developed for the purpose of assisting a musician playing barre chords.

Therefore, it can be appreciated that there exists a need for a new and improved design to assist a musician when playing barre chords on a stringed musical instrument. In this regard, the present invention substantially fulfills this need.

OBJECTS OF THE INVENTION

It is an object of the present invention to provide a tubular finger sleeve with a raised flexible bar to be deployed on a musician's finger for use while playing a stringed musical instrument such as a guitar in a style that allows the musician to contact and depress a number of strings at various fret positions enabling adequate bar pressure.

It is another object of the present invention that the finger sleeve be structured in a manner that allows finger flexibility in order that a musician's finger and fingertip is available for fingerboard fretting.

It is a further object of the present invention that the finger sleeve may be easily and efficiently manufactured and marketed.

An even further object of the present invention is to provide a new and improved finger device for assisting a musician when playing barre chords, overcoming some of the disadvantages of the prior art.

These and other objects and advantages of the present invention will become apparent from the following more detailed description, taken in conjunction with the accompanying drawings which illustrate the invention by way of example.

SUMMARY

In accordance with one embodiment, a tubular finger sleeve comprises an elastomeric material having an affixed raised flexible bar running the length of said sleeve to accommodate the insertion of a musician's finger to aid in performing barre chords by pressing the strings of a guitar or other stringed instrument at various fret positions along a fingerboard enabling adequate bar pressure.

DRAWINGS

Figures

In the drawings, closely related figures have the same number but different alphabetic suffixes.

Figure 1:
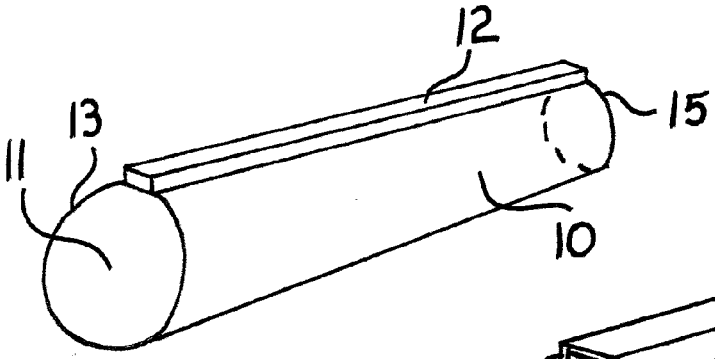
FIG. 1 shows a perspective view of a finger sleeve supplied with an affixed raised flexible bar.
Figure 1B:
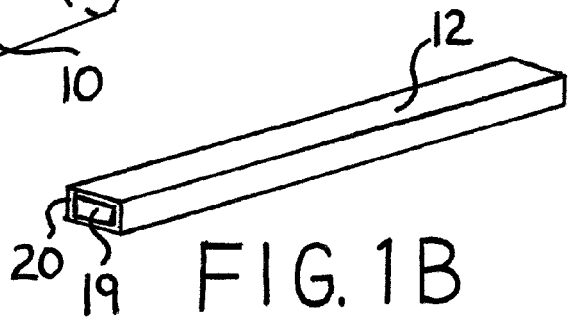
FIG. 1B shows a perspective view of the raised flexible bar as seen in FIG. 1.

| DRAWINGS-Reference Numerals | |
|---|---|
| 10 finger sleeve | 11 internal cavity |
| 12 raised flexible bar | 13 proximal (rear) end |
| 14 index finger (left hand) | 15 distal (forward) end |
| 16 guitar strings | 17 frets |
| 18 guitar fingerboard | 19 inner rubber core |
| 20 fabric sheathing | |

DETAILED DESCRIPTION

FIGS. 1 to 4B

Figure 2:
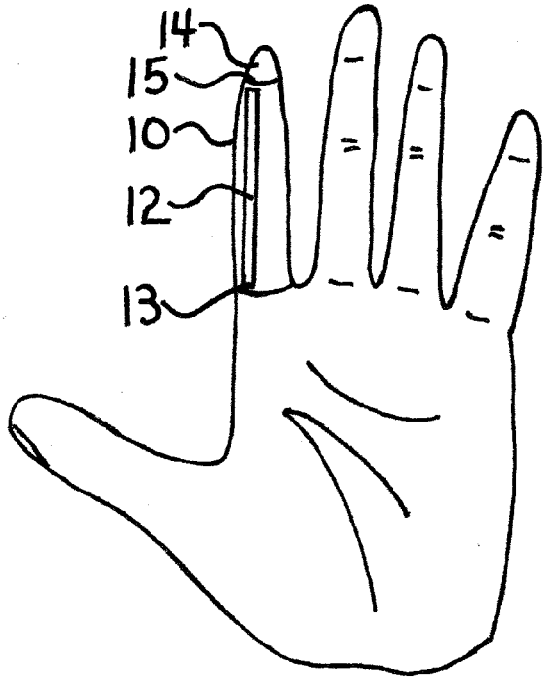
FIG. 2 shows a view of a left, or chord hand, with the finger sleeve shown in FIG. 1 installed on the index finger.
Figure 3:
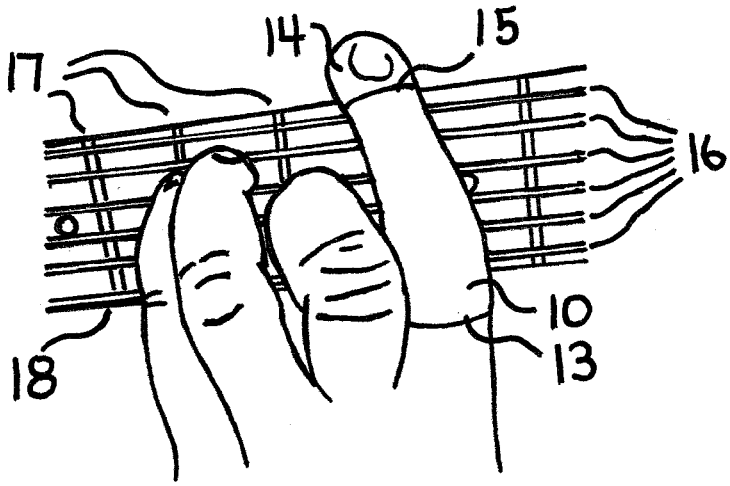
FIG. 3 shows a top view of the finger sleeve installed on the index finger as shown in FIG. 2 as it is presented across the strings of a guitar at a fret location on the guitar fingerboard.
Figure 4:
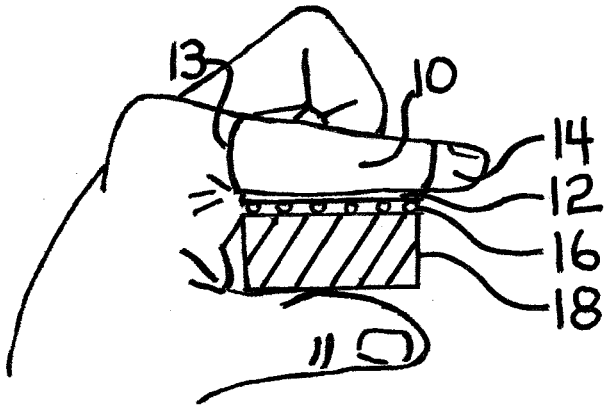
FIG. 4 shows a side view as in FIG. 3 of the finger sleeve presented across the strings of a guitar with the raised flexible bar making contact with the strings.
Figure 4B:
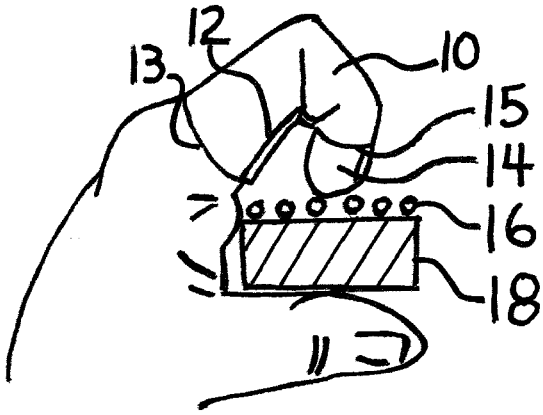
FIG. 4B shows a side view as in FIG. 4 of the finger sleeve as it is bent to accommodate the user's finger tip making contact with an individual string.

One embodiment of a finger sleeve is illustrated in FIGS. 1-4B. The finger sleeve 10 includes a cylindrical body defining an internal cavity 11 for insertion of a musician's finger. The finger sleeve is defined by a gradual tapering from the proximal end 13 to the distal end 15 resulting in a frictional connection with the musician's finger. The finger sleeve 10 is dimensional to accept the insertion of the musician's finger, most often the index finger 14 and typically as far as the second knuckle. The two opposite ends 13 and 15 are inclined so that the rear proximal end 13 has a slightly larger diameter opening than the forward distal end 15 assuring a firm grip on the musician's finger as shown in FIG. 2. As shown in FIG. 2, the finger sleeve 10 is made to be tight fitting. To aid in this purpose, the finger sleeve is constructed of an elastomeric material that is tight-fitting and can be repeatedly bent and straightened without causing restriction of movement. A raised flexible bar 12 is attached to the finger sleeve 10 along the longitudinal axis from the proximal end 13 to the distal end 15. The raised flexible bar 12 is dimensional to provide adequate height to ensure full compression of the guitar strings when required as shown in FIG. 4, while at the same time providing little resistance when bending the finger to press individual strings as shown in FIG. 4B.

In one embodiment, the finger sleeve 10 is approximately 50 mm in length and is constructed of Spandex or similar fabrics that can stretch to accommodate most finger sizes and is of a consistent strength and weight as to not become misshapen after prolonged use. However, the finger sleeve 10 can be constructed of any elastomeric material such as vinyl, rubber, mesh, etc. that can provide the characteristic of being nearly skin-tight around the finger while providing the freedom of movement required for proper function. The finger sleeve 10 is constructed using assembly techniques commonly practiced in the garment industry such as stitching or fabric adhesion.

The raised flexible bar 12 can be made of any suitable material such as leather, rubber, silicone, etc. that provides proper barring functionality while allowing the flexibility required and will be of a length sufficient to cover all strings at various fingerboard positions, approximately 50 mm as shown in FIGS. 3 and 4. In one embodiment, the raised flexible bar 12 is made of elastic cord comprising an inner rubber core 19 and an outer fabric sheathing 20. The fabric sheathing 20 provides a thin barrier between the inner rubber core 19 and the guitar strings 16, providing a smooth gliding surface that will not create a frictional holding effect to the strings when pressed down, slid along, or lifted away from the fingerboard 18. Another embodiment could see the raised flexible bar 12 attached on the inside of the finger sleeve along the inner longitudinal axis. Referring to the previous embodiment, the raised flexible bar 12 is attached to the finger sleeve 10 using a fabric adhesive that provides flexibility and strength when set such as 3M Bonding Film 6004. The raised flexible bar 12 is typically 1 mm-1.2 mm in thickness, 3 mm-4 mm in width, and 50 mm in length, but can be of any size that accomplishes the functionality of the flexible bar and its intended use. In an alternative embodiment, the single raised flexible bar 12 can be replaced by a plurality of raised flexible bars.

Operation—FIGS. 1-4B

The manner of using the finger sleeve is presented for use when assisting a guitarist while playing barre chords. In playing guitar, barre chords are often used to alter the pitch or tone of the chords being played. This is accomplished by using the index finger 14 to depress, or barre, a number of strings 16 at various fret positions 17 along a guitar fingerboard 18 as best shown in FIGS. 3 and 4. In FIG. 3, it shows the left hand of a guitarist in position along the guitar fingerboard 18 with the index finger 14 covering all the strings 16 at a fret position 17 and the remaining fingers in position to form various chord shapes. In this illustration, the finger sleeve 10 is worn on the index finger 14 of the left or chording hand as shown in FIG. 2 with the raised flexible bar 12 adjusted to the underside of the finger in order that the raised flexible bar 12 contacts the strings 16 as shown in FIG. 4. In FIG. 4, it shows a view of the index finger 14 extended straight across the strings 16 in the same configuration along the fingerboard as shown in FIG. 3 with the finger sleeve 10 worn on the finger and the raised flexible bar 12 adjusted to the underside of the finger in order to contact all strings with equal bar pressure.

While playing and performing barre chords, a guitarist often requires the full use of the index finger 14 for additional functions such as pressing an individual string with the fingertip as best shown in FIG. 4B. The bending of the finger requires that the finger sleeve 10 and the raised flexible bar 12 be constructed in a manner that allows the finger a full range of motion, and as described previously, is accomplished in one or more embodiments of the present invention in order that a guitarist can transition quickly from barre chords to open strings.

ADVANTAGES

From the description above, a number of advantages of some embodiments of my finger sleeve become evident:

(a) Is suitable for both right and left-handed players reducing manufacturing costs.
(b) Is fully adjustable on the finger to accommodate any playing style.
(c) Can be quickly deployed and removed as required.
(d) Provides an open end to allow the finger tip a true feel of the guitar strings when playing in open position.
(e) Is light weight and provides very little resistance and encumbrance when playing.
(f) Is one size fits most finger sizes.
(g) Provides comfort to the guitar player when pressing a number of strings while playing barre chords.
(h) Requires no additional adjustments on the finger once in place to achieve full functionality.
(i) Has an aesthetically appealing appearance.
(j) Can be easily and efficiently manufactured and marketed.

CONCLUSION, RAMIFICATIONS, AND SCOPE

Accordingly, the reader will see that the guitar finger sleeve of the various embodiments can easily and conveniently be used to aid a guitarist when playing barre chords by relieving finger and wrist tension, enables a guitarist to provide sufficient barring pressure, can be quickly and easily deployed or removed as required, and is comfortable and non-restrictive on the guitarist's finger. In addition, the finger sleeve can be manufactured in one size and will be of benefit to almost any guitarist whether right or left-handed, or with large or small fingers. Furthermore, the finger sleeve can be graphically designed and printed to match a guitarist's personality such as a national flag or a particular logo. Additionally, the guitar finger sleeve would serve as an exceptional instructional tool for music teachers and their students, allowing the student the ability to perform barre chords much sooner than would normally be expected.

Although the description above contains many specificities, these should not be construed as limiting the scope of the embodiments but as merely providing illustrations of some of the presently preferred embodiments. For example, the finger sleeve can be made of any elastomeric material, such as Spandex, that provides a tight fit but retains its flexibility. The raised flexible bar can be made of any flexible material, such as elastic cord, that will have the rigidity to compress the strings, but have the flexibility to not restrict the bending movement of the finger.

Thus the scope of the embodiments should be determined by the appended claims and their legal equivalents, rather than by the examples given.

I claim:

1. A finger sleeve of the type for playing barre chords on a stringed musical instrument, comprising:

a) a tubular sleeve with proximal and distal end openings, fabricated from an elastomeric material of a predetermined size to provide a tight fit on a musician's finger, and is of adequate length to span the width of a guitar fingerboard, and b) a soft, flexible bar that is affixed the length of said finger sleeve, and is fabricated from an elastomeric material, whereby said finger sleeve can be bent and straightened with little resistance, requiring no adjustment once in place on the finger to alternate between barre and finger playing styles.

2. A finger sleeve of the type for playing barre chords on a stringed musical instrument, comprising:

a) a tubular sleeve with proximal and distal end openings, fabricated from an elastomeric material of a predetermined size to provide a tight fit on a musician's finger, and is of adequate length to span the width of a guitar fingerboard, and b) a plurality of soft, flexible bars that are affixed the length of said finger sleeve, and are fabricated from an elastomeric material, whereby said finger sleeve can be bent and straightened with little resistance, requiring no adjustment once in place on the finger to alternate between barre and finger playing styles.

* * * * *